US011353257B2

(12) United States Patent
Temizkan et al.

(10) Patent No.: US 11,353,257 B2
(45) **Date of Patent: *Jun. 7, 2022**

(54) REFRIGERATION APPLIANCE APPARATUS AND DOMESTIC REFRIGERATION APPLIANCE

(71) Applicant: BSH HAUSGERAETE GMBH, Munich (DE)

(72) Inventors: Senol Temizkan, Aalen (DE); Karl-Friedrich Laible, Langenau (DE); Florian Moertl, Neu-Ulm (DE)

(73) Assignee: BSH Hausgeraete GmbH, Munich (DE)

( * ) Notice: Subject to any disclaimer, the term of this patent is extended or adjusted under 35 U.S.C. 154(b) by 0 days.

This patent is subject to a terminal disclaimer.

(21) Appl. No.: 17/343,128

(22) Filed: Jun. 9, 2021

(65) Prior Publication Data

US 2021/0293469 A1 Sep. 23, 2021

Related U.S. Application Data

(63) Continuation-in-part of application No. 16/737,427, filed on Jan. 8, 2020, now Pat. No. 11,067,334, which is a continuation-in-part of application No. 15/723,355, filed on Oct. 3, 2017, now Pat. No. 10,563,910.

(30) Foreign Application Priority Data

Oct. 4, 2016 (DE) ..... 102016219161.6

(51) Int. Cl.

| | |
|---|---|
| ***F25D 23/12*** | (2006.01) |
| ***B67D 3/02*** | (2006.01) |
| ***F25D 23/06*** | (2006.01) |
| ***F25D 23/02*** | (2006.01) |
| ***B67D 3/00*** | (2006.01) |

(52) U.S. Cl.

CPC ..... *F25D 23/126* (2013.01); *B67D 3/0009* (2013.01); *B67D 3/0083* (2013.01); *B67D 3/02* (2013.01); *F25D 23/028* (2013.01); *F25D 23/065* (2013.01)

(58) Field of Classification Search

CPC ..... B67D 3/02; B67D 3/0009; B67D 1/0081; F25D 11/00; F25D 11/02; F25D 23/066; F25D 23/126

USPC ..... 141/351, 362; 62/389

See application file for complete search history.

(56) References Cited

U.S. PATENT DOCUMENTS

| | | | | |
|---|---|---|---|---|
| 4,651,789 A * | 3/1987 | Linstromberg | B67D 1/124 | 141/360 |
| 4,800,935 A | 1/1989 | Buchser | B67D 1/08 | 141/362 |
| 5,474,213 A | 12/1995 | Unger | F25C 5/005 | 141/86 |
| 6,039,219 A * | 3/2000 | Bach | B67D 3/0009 | 141/362 |

(Continued)

*Primary Examiner* — Timothy L Maust

(74) *Attorney, Agent, or Firm* — Laurence A. Greenberg; Werner H. Stemer; Ralph E. Locher

(57) ABSTRACT

A refrigeration appliance apparatus has an appliance body and an appliance door delimiting a refrigeration chamber. A water-dispensing unit is disposed on a side wall of the appliance body or appliance door. The water-dispensing unit has a guide for dispensing water and at least one actuating unit.

23 Claims, 8 Drawing Sheets

(56) References Cited

U.S. PATENT DOCUMENTS

| | | | | |
|---|---|---|---|---|
| 7,455,085 | B2 | 11/2008 | Voglewede | F25D 23/126 141/18 |
| 7,493,774 | B2 | 2/2009 | Ferragut, II | B67D 1/0009 62/177 |
| 7,587,910 | B2 | 9/2009 | Bowen | F25D 23/126 62/389 |
| 7,841,493 | B2 | 11/2010 | Park | F25D 23/126 222/477 |
| 8,646,288 | B2 * | 2/2014 | Lim | B67D 1/14 62/389 |
| 9,010,580 | B2 | 4/2015 | Rolek | F25D 23/126 141/94 |
| 9,073,743 | B2 | 7/2015 | Sanchez | B67D 7/56 |
| 9,567,201 | B2 | 2/2017 | Seo | F25D 23/126 |
| 10,473,387 | B2 * | 11/2019 | Temizkan | F25D 11/00 |
| 10,563,910 | B2 | 2/2020 | Temizkan | F25D 11/00 |
| 10,571,185 | B2 | 2/2020 | Temizkan | F25D 23/126 |
| 11,067,334 | B2 * | 7/2021 | Temizkan | B67D 3/02 |
| 2008/0163641 | A1 | 7/2008 | Mitchell | B67D 1/0875 62/389 |
| 2008/0178628 | A1 | 7/2008 | Jang | F25C 1/24 62/389 |
| 2010/0319388 | A1 | 12/2010 | Yang | F25C 5/22 62/389 |

* cited by examiner

REFRIGERATION APPLIANCE APPARATUS AND DOMESTIC REFRIGERATION APPLIANCE

CROSS-REFERENCE TO RELATED APPLICATION

This application is a continuation-in-part of patent application Ser. No. 16/737,427, filed Jan. 8, 2020; which was a continuation-in-part of application Ser. No. 15/723,355, filed Oct. 3, 2017, now U.S. Pat. No. 10,563,910; this application also claims the priority, under 35 U.S.C. § 119, of German patent application No. DE 10 2016 219 161, filed Oct. 4, 2016; the prior applications are herewith incorporated by reference in their entirety.

BACKGROUND OF THE INVENTION

Field of the Invention

The invention relates to a refrigeration appliance apparatus, in particular a domestic refrigeration appliance apparatus.

A refrigeration appliance apparatus with a water-dispensing unit which comprises an actuating unit is already known from the prior art. For the starting of a water removal, the actuating unit has an operating element. Embodiments are known in which the operating element is arranged within a dispensing region of the water-dispensing unit. In alternative embodiments, the operating element is arranged outside a dispensing region of the water-dispensing unit.

SUMMARY OF THE INVENTION

It is accordingly an object of the invention to provide a refrigeration appliance which overcomes a variety of disadvantages of the heretofore-known devices and methods of this general type and which provides for improved properties with regard to an operating convenience.

According to an aspect of the present disclosure, the refrigeration appliance apparatus, comprising an appliance body and an appliance door; a water-dispensing unit disposed on a side wall of the appliance body or appliance door, wherein the water-dispensing unit having a guide for dispensing water; the water-dispensing unit having at least one actuating unit, wherein the actuating unit having a first operating element and at least one additional second operating element for starting a water removal through the guide.

According to another aspect of the present disclosure, the refrigeration appliance apparatus, comprising an appliance body and an appliance door; a water-dispensing unit disposed on a side wall of the appliance body or appliance door, wherein the water-dispensing unit having a guide for dispensing water; the water-dispensing unit having at least one dispensing region and at least one guide configured for guiding water, the guide, in an installed position, being disposed in a cover region of the at least one dispensing region of the water-dispensing unit; and the water-dispensing unit having at least one actuating unit with at least one actuating element provided for starting a water removal, the actuating element including at least one actuating portion which protrudes into the dispensing region and projects behind the guide A "refrigeration appliance apparatus," in particular, a "domestic refrigeration appliance apparatus" should be understood, in particular, to be at least a part, in particular a subassembly, of a refrigeration appliance, in particular a domestic refrigeration appliance. Particularly advantageously, a refrigeration appliance and advantageously a refrigeration appliance configured as a domestic refrigeration appliance is provided, in at least one operational state, to cool refrigeration goods, in particular food, for example, drinks, meat, fish, milk and/or milk products, in particular in order to bring about a longer storage capability of the refrigeration goods. The refrigeration appliance and advantageously the refrigeration appliance configured as a domestic refrigeration appliance can be, in particular, a cooling chest and advantageously a refrigerating and/or freezing cabinet.

"Water" should be understood, for example, as a chemical composition of two hydrogen atoms and one oxygen atom, specifically regardless of an aggregation state. The water could be present, for example, as a liquid and/or as a solid and/or as a mixture of a liquid and a solid. A "water-dispensing unit" should be understood, in particular, as a unit which is provided for an output and/or provision of water, in particular to an operator.

An "actuating unit" should be understood, for example, as a unit which is provided for an actuation by an operator and/or which is provided to activate and/or start and/or initiate at least one water removal. An "operating element" should be understood, in particular, as an element which is provided for an actuation by an operator and which, in particular, for the actuation is arranged to be touchable and/or visible. In particular, the operating element could be configured as a knob and/or as a button and/or as a switch and/or as a lever. The operating element could, for example, be provided for a direct actuation by an operator. In particular, the operating element, which is provided, in particular, for a direct actuation by an operator, could be provided for touching by at least one operator, in particular by at least one body part of an operator, advantageously by at least one hand of an operator and preferably by at least one finger of an operator. Alternatively or additionally, the operating element could, for example, be provided for an indirect actuation by an operator. In particular, the operating element, which is provided, in particular, for an indirect actuation by an operator, could be provided for touching by at least one vessel which could, in particular, be guided and/or touched by the operator. The operating element which is provided, in particular, for an indirect actuation by an operator, could be provided, in particular, for one-handed actuation, in particular, by an operator. The vessel could be, for example, a bowl and/or a beaker and/or a glass, in particular a drinking glass, and/or a bottle and/or a cup and/or a bucket.

"Provided" should be understood, in particular, as especially programmed, designed and/or equipped. That an object is provided for a particular function should be understood as meaning that the object fulfills and/or carries out this particular function in at least one usage and/or operational state.

With the inventive embodiment, for example, a high degree of operating convenience can be achieved. In particular, a high degree of flexibility in relation to a manner of starting a water removal can be achieved. A one-handed operation can be enabled, in particular, specifically advantageously up to a maximum diameter of a vessel of 120 mm. Vessels with a diameter of more than 120 mm can be filled, in particular, by means of a direct actuation of at least one of the operating elements. In particular, a filling of vessels with a diameter in a range of at least 50 mm and a maximum of 300 mm can be enabled.

It is further proposed according to the present disclosure that the first operating element is arranged at least substantially and, in particular, completely outside at least one dispensing region of the water-dispensing unit. A "dispensing region" should be understood, in particular, as a region into which, in particular, following a starting of a water removal, an output of water takes place and/or which is provided in particular for an arrangement of at least one vessel into which, in particular, the dispensing of water takes place. In an installed position, the dispensing region is arranged, in particular, at least substantially beneath at least one water-guiding element, in particular, beneath at least one opening in the water-guiding element and/or at least one end of the water-guiding element. In particular, the first operating element is, in particular mainly and/or predominantly provided for a direct actuation by an operator and is configured, in particular, as a button and/or a knob. With the expression that the first operating element is arranged at least "substantially outside" at least one dispensing region of the water-dispensing unit, it should be understood, in particular, that the first operating element is arranged in a mass proportion and/or a volumetric proportion of at least 70%, in particular at least 80%, advantageously at least 90% and preferably at least 95% outside the dispensing region of the water-dispensing unit. Thereby, in particular, a good accessibility of the first operating element can be achieved, so that, in particular, a convenient and/or unhindered actuation can be enabled.

It is further proposed according to the present disclosure that the second operating element is arranged at least substantially and, in particular, completely within at least one dispensing region of the water-dispensing unit. In particular, the second operating element is, in particular, mainly and/or predominantly provided for an indirect actuation by an operator and is configured, in particular, as a switch and/or a lever. With the expression that the second operating element is arranged at least "substantially inside" at least one dispensing region of the water-dispensing unit, it should be understood, in particular, that the second operating element is arranged in a mass proportion and/or a volumetric proportion of at least 70%, in particular at least 80%, advantageously at least 90% and preferably at least 95% inside the dispensing region of the water-dispensing unit. By this means, in particular, a one-handed operation can be enabled.

It is further proposed according to the present disclosure that the second operating element could be arranged, for example, in a rearward region of the dispensing region and could be configured, for example, as a button and/or as a knob. In particular, the second operating element could be arranged and/or integrated at least partially into a wall which at least rearwardly delimits the dispensing region. Preferably, the second operating element is arranged, in an installed position, at least partially in a cover region of the dispensing region of the water-dispensing unit. In an installed position, the cover region faces away, in particular, from a subsurface and/or is configured as a region of the dispensing region facing away from the subsurface. The subsurface could be, for example, a ground, in particular a floor and/or a support surface. Thereby, in particular, an at least largely free dispensing region can be provided, so that, in particular, an unhindered introduction of vessels into the dispensing region can be enabled.

For example, the actuating unit could comprise at least two switch elements. A first switch element of the switch elements could, in particular, be associated with the first operating element and, in particular, could be actuatable by the first operating element. A second switch element of the switch elements could, in particular, be associated with the second operating element and, in particular, could be actuatable by the second operating element. Preferably, the actuating unit comprises at least one switch element which is associated in particular with the first operating element and the second operating element and which is actuatable by the first operating element and by the second operating element. In particular, the first operating element is provided in order to actuate the switch element, in particular, directly and/or indirectly. In particular, the second operating element is provided in order to actuate the switch element, in particular, directly and/or indirectly. A "switch element" should be understood, in particular, as an element which has at least two switching states and which is provided to change a switching state dependent upon an actuation. The switch element prevents, in particular, in at least one first switching state of the switching states, a water removal and, in at least one second switching state of the switching states, enables a water removal. The switch element could be configured, for example, so as to be electrical and/or mechanical and/or magnetic. By this means, in particular, low costs can be achieved since, in particular, an additional switch element can be dispensed with and, in particular, only a single switch element is needed for two operating elements.

It is further proposed according to the present disclosure that the actuating unit comprises at least one actuating element which mechanically couples the first operating element and the second operating element to one another. The actuating element couples, in particular, a movement of the first operating element and a movement of the second operating element to one another. In particular, the actuating element creates an at least substantially rigid connection between the first operating element and the second operating element. The actuating element couples, in particular, the first operating element and the second operating element to one another. For example, the first operating element and/or the second operating element can be arranged and/or fastened on the actuating element and advantageously connected to the actuating element, in particular, to be releasable without tools. The first operating element and/or the second operating element could be connected to the actuating element, for example, by means of a snap-in connection and/or by means of a connection created by locking and/or by means of a connection created by gluing and/or by means of a screw connection. Advantageously, the first operating element and/or the second operating element are connected integrally to the actuating element. By this means, in particular, a high degree of stability can be achieved. Furthermore, an advantageous operability can be achieved.

For example, the first operating element and the second operating element can each be provided to actuate the switch element, in particular, dependent upon an actuation of the corresponding operating element. Preferably, the actuating element is provided to actuate the switch element, in particular, dependent upon an actuation of the first operating element and/or of the second operating element. By this means, in particular, a compact configuration can be achieved. In particular, further switch elements can be dispensed with, such that, in particular, low costs can be enabled.

It is further proposed according to the present disclosure that the water-dispensing unit comprises at least one guiding unit which is provided for a guidance of water. A "guiding unit" should be understood, in particular, as a unit which delimits and/or defines at least one movement path and which, in particular, guides water directly and/or indirectly along the movement path. For example, the guiding unit could be provided for a direct guidance of water. The guiding unit could guide the water, in particular, along the movement path and, in particular, be arranged in contact with the guided water. Alternatively or additionally, the guiding unit could be provided for an indirect guidance of water. For example, the guiding unit could guide at least one water-guiding element along the movement path. The water-guiding element could be provided, in particular, for a direct guidance of water and could be arranged, in particular, in contact with the guided water. For example, the water-guiding element could be configured as a hose and/or as a channel. Thereby, in particular, a specific and/or directed water removal can be enabled, so that, in particular, a high degree of operating convenience can be provided.

It is further proposed according to the present disclosure that the actuating unit and the guiding unit are part of a mounting assembly which, in particular, occupies an installation space with a volume of not more than 30 $cm^3$, in particular not more than 27 $cm^3$, advantageously not more than 24 $cm^3$, particularly advantageously not more than 22 $cm^3$ and preferably not more than 21 $cm^3$. A "mounting assembly" should be understood, in particular, as a group of elements and/or units which are joined together and/or built together into a single unit, in particular during a pre-assembly and, in particular, are provided exclusively as a unit for a further use, in particular for a further mounting. By this means, in particular, a compact configuration can be achieved and/or installation space can be spared. In particular, a low installation depth can be achieved so that a use of the mounting assembly and/or of the refrigeration appliance apparatus, in particular, of the domestic refrigeration appliance apparatus can be enabled in different refrigeration appliances, in particular, in different domestic refrigeration appliances. In the case of a mounting in a vicinity of an insulation of a refrigeration appliance, in particular a domestic refrigeration appliance, in particular, a small weakening of the insulation can be achieved, so that, in particular, a small risk of condensation can be obtained. In particular, in the case of a mounting taking place before a foam filling, a small impairment of a spread of insulation material, in particular foam, can be achieved.

It is further proposed according to the present disclosure that the guiding unit comprises at least one accommodating region in which the actuating element is at least partially arranged, in at least one mounted state. For example, the guiding unit could surround and/or encompass at least one portion of the actuating element in at least one plane relative to a center point and/or center of gravity of the portion over an angular region of at least 90°, in particular at least 180°, advantageously at least 270°, particularly advantageously at least 330° and preferably at least 350°. In particular, the guiding unit has at least one projection and advantageously at least two projections which at least partially delimit the accommodating region. The portion of the actuating element is arranged, in particular, in a vicinity of the guiding unit and extends in particular at least substantially parallel to the guiding unit. Thereby, the actuating element can be arranged, in particular, at least partially protected.

For example, the refrigeration appliance apparatus could comprise at least one appliance door on which, in particular, the water-dispensing unit could be arranged. In particular, the water-dispensing unit could be arranged, in at least one operational state, outside at least one refrigeration chamber which could be at least partially defined and/or delimited, in particular, by at least one appliance body and/or by at least one inner liner. Preferably, the refrigeration appliance apparatus, in particular, the domestic refrigeration appliance apparatus comprises at least one inner liner which comprises at least one side wall on which the water-dispensing unit is arranged and/or on which the water-dispensing unit is, in particular, fastened. An "inner liner" should be understood, in particular, as a unit which in at least one operational state at least substantially and, in particular, taking account of a seal tolerance completely delimits and/or defines at least one refrigeration chamber at least partially and, in particular, together with at least one appliance door. In particular, the inner liner forms at least one delimitation of the refrigeration chamber. In at least one operational state, the water-dispensing unit is arranged, in particular, at least largely within the refrigeration chamber and/or is accessible via the refrigeration chamber. "At least largely" should be understood as being, in particular, in a mass proportion and/or volume proportion of at least 70%, in particular at least 80%, advantageously at least 90% and preferably at least 95%. Thereby, in particular, a high degree of stability and/or a protected arrangement of the water-dispensing unit can be achieved.

The water-dispensing unit could, for example, be formed connected at least partially integrally with the side wall and/or at least partially be formed by the side wall. For example, the side wall could form at least one wall element of the water-dispensing unit. Preferably, the side wall has at least one recess in which the water-dispensing unit is arranged in at least one mounted state. A "recess" should be understood, in particular, as an opening and/or a hole. In particular, the water-dispensing unit is integrated, in at least one mounted state, into the side wall and is advantageously fitted into and/or mounted in the recess of the side wall. By this means, in particular, a separate housing for the water-dispensing unit can be dispensed with, so that, in particular, low costs can be achieved. In particular, a maximally sized refrigeration chamber can be provided since, in particular, an arrangement of a separate water-dispensing unit can be dispensed with, so that, in particular, a high degree of operating convenience can be enabled.

A "guiding unit" should be understood, in particular, as a unit which delimits and/or defines at least one movement path and which, in particular, guides water directly and/or indirectly along the movement path. For example, the guiding unit could be provided for a direct guidance of water. The guiding unit could guide the water, in particular, along the movement path and, in particular, be arranged in contact with the guided water. Alternatively or additionally, the guiding unit could be provided for an indirect guidance of water. For example, the guiding unit could guide at least one water-guiding element along the movement path. The water-guiding element could be provided, in particular, for a direct guidance of water and could be arranged, in particular, in contact with the guided water. For example, the water-guiding element could be configured as a hose and/or as a channel.

A "dispensing region" should be understood, in particular, as a region into which, in particular, following a starting of a water removal, an output of water takes place and/or which is provided in particular for an arrangement of at least one vessel into which, in particular, the dispensing of water takes place. In an installed position, the dispensing region is arranged, in particular, at least substantially beneath at least one water-guiding element, in particular, beneath at least one opening in the water-guiding element and/or at least one end of the water-guiding element. In an installed position, the cover region faces away, in particular, from a subsurface and/or is configured as a region of the dispensing region facing away from the subsurface. The subsurface could be, for example, a ground, in particular a floor and/or a support surface.

An "actuating unit" should be understood, in particular, as a unit which is provided for an actuation by an operator and/or which is provided to activate and/or start and/or initiate at least one water removal.

The water-dispensing unit has at least one operating element. In particular, the actuating element is coupled to the operating element. The water-dispensing unit has, in particular, at least one switch element for stating a water removal. The actuating element is, in particular, provided to actuate the switch element, in particular, dependent upon an actuation of the operating element. In particular, the switch element starts a water removal dependent upon an actuation of the switch element by the actuating element. A "switch element" should be understood, in particular, as an element which has at least two switching states and which is provided to change a switching state dependent upon an actuation. The switch element prevents, in particular, in at least one first switching state of the switching states, a water removal and, in at least one second switching state of the switching states, enables a water removal. The switch element could be configured, for example, so as to be electrical and/or mechanical and/or magnetic.

An "inner liner" should be understood, in particular, as a unit which in at least one operational state at least substantially and, in particular, taking account of a seal tolerance completely delimits and/or defines at least one refrigeration chamber at least partially and, in particular, together with at least one appliance door. In particular, the inner liner forms at least one delimitation of the refrigeration chamber. In at least one operational state, the water-dispensing unit is arranged, in particular, at least largely within the refrigeration chamber and/or is accessible via the refrigeration chamber.

It is further proposed according to the present disclosure that the actuating portion is a subregion of the actuating element. In an installed position, the actuating element is arranged, in particular, at least partially and advantageously with the exception of the actuating portion, completely above the dispensing region of the water-dispensing unit. In an installed position, the actuating portion is arranged, in particular, at least largely in the cover region of the dispensing region. "At least largely" should be understood as being, in particular, in a mass proportion and/or volume proportion of at least 70%, in particular at least 80%, advantageously at least 90% and preferably at least 95%. In at least one mounted state, the actuating portion is arranged, in particular, at least partially behind the guiding unit and, in particular, at least partially covered by the guiding unit. The actuating portion has, in particular, at least one longitudinal extent which, in particular, is greater than an extent of the guiding unit parallel to the longitudinal extent of the actuating portion. In particular, the actuating portion protrudes beyond the guiding unit in a longitudinal extent direction of the actuating portion by an extent by which the longitudinal extent of the actuating portion is greater than the extent of the guiding unit parallel to the longitudinal extent of the actuating portion. A "longitudinal extent" of an object should be understood, in particular, to be an extent of the object along a longitudinal direction of the object. An "extent" of an object should be understood, in particular, to be a maximum spacing of two points of a perpendicular projection of the object onto a plane. A "longitudinal extent direction" of an object should be understood, in particular, as a direction which is oriented parallel to a longest side of a smallest imaginary geometrical cuboid which just completely encloses the object.

"Provided" should be understood, in particular, as especially programmed, designed and/or equipped. That an object is provided for a particular function should be understood as meaning that the object fulfills and/or carries out this particular function in at least one usage and/or operational state.

With the inventive embodiment, in particular, a high degree of operating convenience can be achieved. Through an arrangement of the guiding unit in the cover region of the dispensing region, in particular, an at least largely free dispensing region can be provided, so that, in particular, an unhindered introduction of vessels into the dispensing region can be enabled. In particular, an optimized operation can be enabled since an operator can optimally actuate the actuating portion. Through an arrangement of the actuating portion in a region close to the guiding unit, in particular, a one-handed operation, in particular, by means of a vessel can be enabled.

It is further proposed that the actuating element comprises at least one hook which is arranged on the actuating portion and is oriented in the direction of the guiding unit. For example, the projection could be fastened to the actuating portion as, for example, by means of a force-fitting and/or form-fitting connection. In particular, the hook is connected integrally with the actuating portion and is advantageously configured as a projection on the actuating portion. In at least one assembled state, the hook is arranged, in particular, on a side of the actuating portion facing toward the guiding unit. "Integrally" should be understood as meaning, in particular, at least bonded, for example, by means of a welding process, a gluing process, a molding-on process and/or another process deemed suitable by a person skilled in the art, and/or advantageously formed in one piece, for example by manufacturing from a casting and/or by means of production in a single-component or multi-component injection molding process and advantageously from a single blank. Thereby, in particular, a particularly high level of operating convenience can be achieved.

The hook could be free, for example, from engagement elements and have, in particular, an at least substantially planar surface. Preferably, the hook comprises, in particular, in at least one assembled state on a side facing toward the guiding unit and, in particular, an operator, at least one engagement region which is provided for an engagement of at least one vessel. In particular, the engagement region is provided, in at least one removal state in which, in particular, an operator actuates the actuating element by means of at least one vessel and, in particular, starts a water removal, to be arranged in contact with at least one subregion of a surface of the vessel. By this means, in particular, a high degree of operator friendliness can be achieved.

Furthermore, it is proposed that the hook in the engagement region, in particular when viewing the water-dispensing unit from at least one refrigeration chamber which could be at least partially defined by the inner liner, has an at least substantially concavely curved form. By this means, in particular, an engagement region optimally adapted to a shape of a vessel can be provided, so that in particular a simple and/or convenient actuation of the actuating portion can be achieved.

It is further proposed that the actuating portion has an at least substantially and, particularly, taking account of a manufacturing tolerance, completely web-shaped form. An at least "substantially web-shaped" form of the actuating portion should be understood as meaning that the actuating portion fills a smallest imaginary geometric cuboid which has a web-shaped form in a volumetric proportion of at least 70%, in particular at least 80%, advantageously at least 90% and preferably at least 95%. Thereby, in particular, a simple and/or economical production can be achieved.

It is also proposed that the actuating unit comprises at least one first operating element and at least one second operating element which are each provided for starting a water removal. An "operating element" should be understood, in particular, as an element which is provided for an actuation by an operator and which, in particular, for the actuation is arranged to be touchable and/or visible. In particular, the operating element could be configured as a knob and/or as a button and/or as a switch and/or as a lever. The operating element could, for example, be provided for a direct actuation by an operator. In particular, the operating element, which is provided, in particular, for a direct actuation by an operator, could be provided for touching by at least one operator, in particular by at least one body part of an operator, advantageously by at least one hand of an operator and preferably by at least one finger of an operator. Alternatively or additionally, the operating element could, for example, be provided for an indirect actuation by an operator. In particular, the operating element, which is provided, in particular, for an indirect actuation by an operator, could be provided for touching by at least one vessel which could, in particular, be guided and/or touched by the operator. The operating element which is provided, in particular, for an indirect actuation by an operator, could be provided, in particular, for one-handed actuation, in particular, by an operator. The vessel could be, for example, a bowl and/or a beaker and/or a glass, in particular a drinking glass, and/or a bottle and/or a cup and/or a bucket. Thereby, in particular, a high degree of operating convenience can be achieved. In particular, a high degree of flexibility in relation to a manner of starting a water removal can be achieved. A one-handed operation can be enabled, in particular, specifically advantageously up to a maximum diameter of a vessel of 120 mm. Vessels with a diameter of more than 120 mm can be filled, in particular, by means of a direct actuation of at least one of the operating elements. In particular, a filling of vessels with a diameter in a range of at least 50 mm and a maximum of 300 mm can be enabled.

It is further proposed that the first operating element is arranged at least substantially and, in particular, completely outside at least one dispensing region of the water-dispensing unit. In particular, the first operating element is, in particular mainly and/or predominantly provided for a direct actuation by an operator and is configured, in particular, as a button and/or a knob. With the expression that the first operating element is arranged at least "substantially outside" at least one dispensing region of the water-dispensing unit, it should be understood, in particular, that the first operating element is arranged in a mass proportion and/or a volumetric proportion of at least 70%, in particular at least 80%, advantageously at least 90% and preferably at least 95% outside the dispensing region of the water-dispensing unit. Thereby, in particular, a good accessibility of the first operating element can be achieved, so that, in particular, a convenient and/or unhindered actuation can be enabled.

It is further proposed that the second operating element is arranged at least substantially and, in particular, completely within at least one dispensing region of the water-dispensing unit. In particular, the second operating element is, in particular, mainly and/or predominantly provided for an indirect actuation by an operator and is configured, in particular, as a switch and/or a lever. With the expression that the second operating element is arranged at least "substantially inside" at least one dispensing region of the water-dispensing unit, it should be understood, in particular, that the second operating element is arranged in a mass proportion and/or a volumetric proportion of at least 70%, in particular at least 80%, advantageously at least 90% and preferably at least 95% inside the dispensing region of the water-dispensing unit. By this means, in particular, a one-handed operation can be enabled.

For example, the actuating portion and the first operating element and the second operating element can be arranged separately from one another. Preferably, the second operating element is formed at least partially by the actuating portion. With the expression that the second operating element is formed "at least partially" by the actuating portion, it should be understood, in particular, that the second operating element is formed by the actuating portion alone and/or by the actuating portion and additionally by at least one further element, such as for example, by the hook. By this means, in particular, a low inventory holding and/or a low variety of components can be achieved.

Furthermore, it is proposed that the refrigeration appliance apparatus comprises at least one faceplate unit which, in at least one mounted state, covers the water-dispensing unit at least largely and, in particular, with the exception of the first operating element, the second operating element and the guiding unit, completely. Seen from at least one refrigeration chamber delimited at least partially by at least one inner liner, the water-dispensing unit is arranged, in particular, at least largely behind the faceplate unit. Thereby, in particular, a protected arrangement of the water-dispensing unit can be achieved and/or a high degree of design freedom of the faceplate unit can be enabled.

Furthermore, it is proposed that the faceplate unit, in particular, when the water-dispensing unit is seen from at least one refrigeration chamber which could be, in particular, at least partially defined by the inner liner, has an at least substantially concave curved form. By this means, in particular, a faceplate unit optimally adapted to a shape of a vessel can be provided, so that in particular a simple and/or convenient introduction of a vessel into the dispensing region can be enabled.

A particularly high degree of operating convenience can be achieved, in particular, by a refrigeration appliance, in particular a domestic refrigeration appliance, comprising at least one inventive refrigeration appliance apparatus, in particular with at least one inventive domestic refrigeration appliance apparatus.

The refrigeration appliance apparatus is not intended to be restricted hereby to the above described use and embodiment. In particular, the refrigeration appliance apparatus can have, for a fulfillment of a functional method described herein, a number of individual elements, components and units deviating from a number mentioned herein.

Further advantages are disclosed by the following description of the drawings. The drawings show exemplary embodiments of the invention. The drawings and the claims contain numerous features in combination. A person skilled in the art will also suitably consider the features individually and group them into other useful combinations.

DETAILED DESCRIPTION OF THE INVENTION

Figure 1:
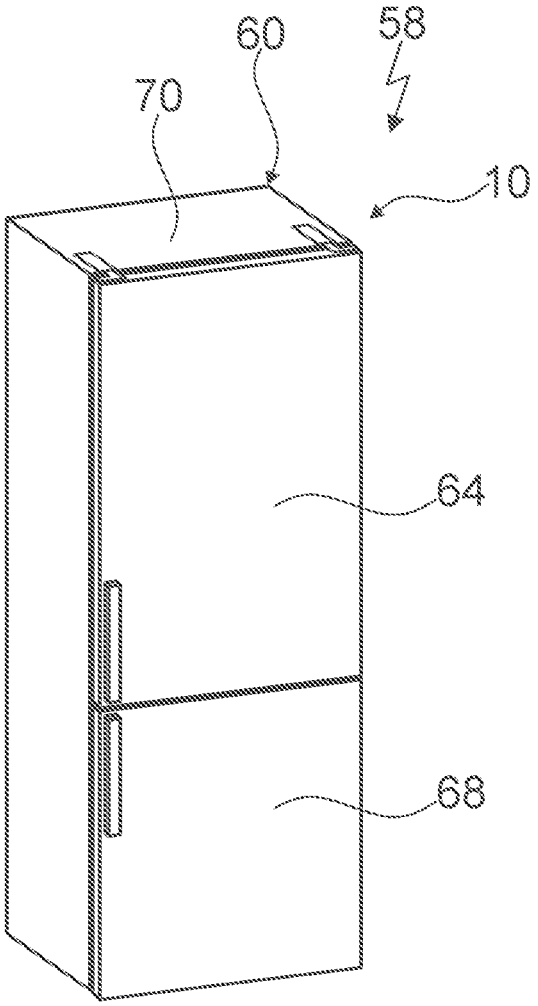
FIG. 1 shows a refrigeration appliance with a refrigeration appliance apparatus in an operational state in a schematic representation.

FIG. 1 shows a refrigeration appliance 58 which is configured as a domestic refrigeration appliance, in an operational state. The refrigeration appliance 58 is configured as a refrigeration appliance and as a freezer device, in particular as a fridge-freezer combination appliance. The refrigeration appliance 58 comprises a refrigeration appliance apparatus 10 which is configured as a domestic refrigeration appliance apparatus. The refrigeration appliance apparatus 10 comprises an appliance body 60.

Figure 2:
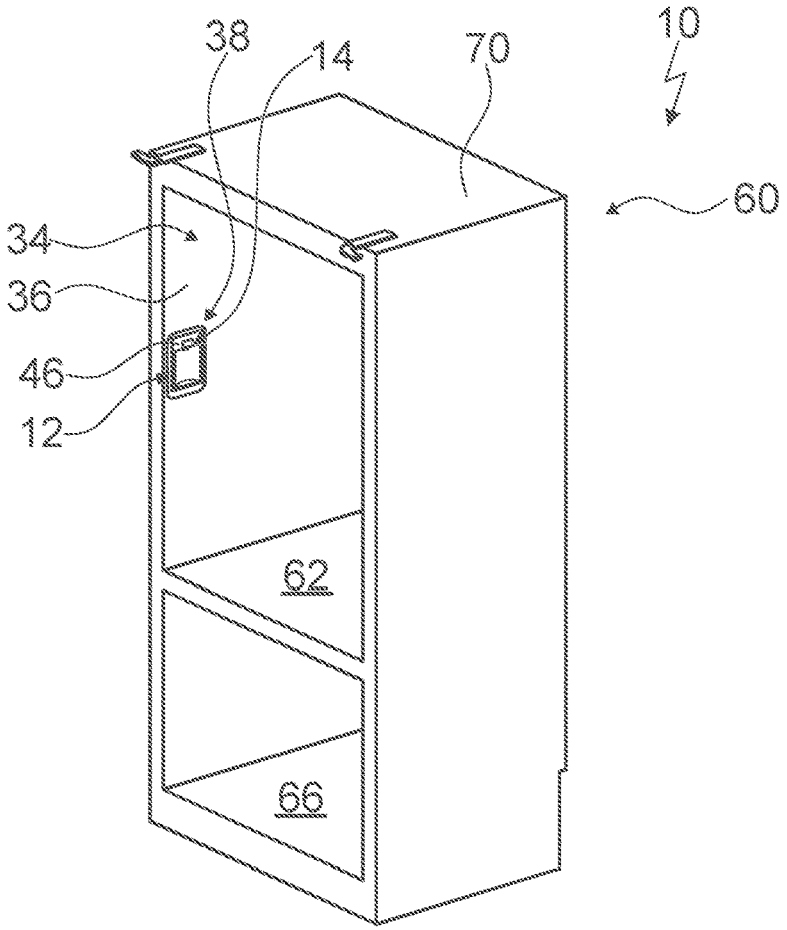
FIG. 2 shows an appliance body, a water-dispensing unit and a faceplate unit of the refrigeration appliance apparatus, wherein a representation of appliance doors, shelves, containers and storage units has been dispensed with in a schematic, strongly simplified representation.

The appliance body 60 partially defines a refrigeration chamber 62 (see FIG. 2). The refrigeration chamber 62 is configured as a cooling chamber. The refrigeration appliance apparatus 10 comprises an appliance door 64. The appliance door 64 is mounted pivotably relative to the appliance body 60. In the operational state, the appliance body 60 and the appliance door 64 define the refrigeration chamber 62 partially and, in particular, taking account of a seal tolerance, completely.

The appliance body 60 partially defines a further refrigeration chamber 66 (see FIG. 2). The further refrigeration chamber 66 is configured as a freezing chamber. The refrigeration appliance apparatus 10 comprises a further appliance door 68. The further appliance door 68 is mounted pivotably relative to the appliance body 60. In the operational state, the appliance body 60 and the further appliance door 68 define the further refrigeration chamber 66 substantially and, in particular, taking account of a seal tolerance, completely. In an installed position, the further refrigeration chamber 66 is arranged beneath the refrigeration chamber 62.

Figure 3:
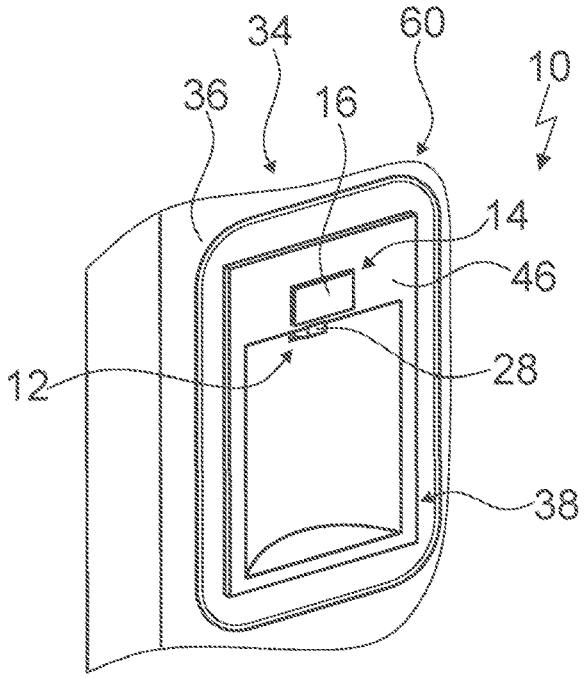
FIG. 3 shows an enlarged detail view of FIG. 2.
Figure 4:
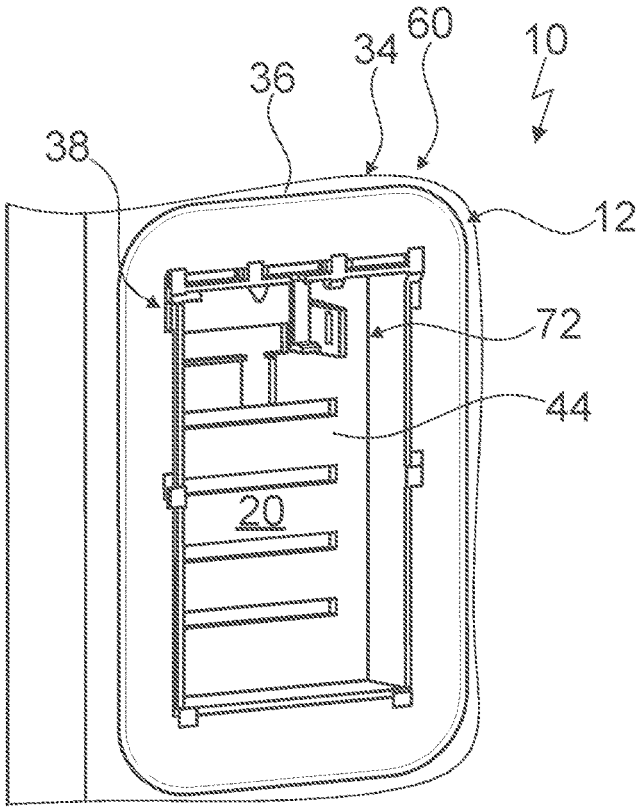
FIG. 4 shows a side wall of an inner liner of the refrigeration appliance apparatus and a wall element of the water-dispensing unit in a schematic plan view.

The refrigeration appliance apparatus 10 comprises an inner liner 34 (see FIGS. 2 and 3). The inner liner 34 is part of the appliance body 60. The refrigeration appliance apparatus 10 comprises an outer liner 70 (see FIGS. 1 and 2). The outer liner 70 is part of the appliance body 60. The inner liner 34 and the outer liner 70 are connected to one another in a mounted state.

The inner liner 34 and the outer liner 70 enclose an inner chamber. The inner chamber is provided for an insulation. In the operational state, an insulation (not shown) is arranged in the inner chamber.

The inner liner 34 comprises a side wall 36 (see FIGS. 2 and 3). A water-dispensing unit 12 is arranged on the side wall 36. The water-dispensing unit 12 is provided for an output of water. The water-dispensing unit 12 is accessible via the refrigeration chamber 62.

The refrigeration appliance apparatus 10 comprises the water-dispensing unit 12. In the mounted state, the water-dispensing unit 12 is arranged in a recess 38 of the side wall 36. The side wall 36 comprises the recess 38. In the mounted state, the water-dispensing unit 12 is arranged in the recess 38 of the side wall 36.

The water-dispensing unit 12 comprises a wall element 44 (see FIGS. 4 to 7). In the mounted state, the wall element 44 is foam mounted in the recess 38 of the side wall 36. In the mounted state, the wall element 44 is arranged in the recess 38 of the side wall 36.

In the present exemplary embodiment, the wall element 44 has a substantially trough-shaped form. The wall element 44 partially defines a dispensing region 20 of the water-dispensing unit 12. The water-dispensing unit 12 comprises the dispensing region 20.

The wall element 44 partially defines a mounting chamber 72 which is provided, in particular for mounting components of the water-dispensing unit 12. In an installed position, the mounting chamber 72 is arranged above the dispensing region 20. The dispensing region 20 and the mounting chamber 72 adjoin one another. In the mounted state, a mounting assembly 30 of the water-dispensing unit 12 is arranged in the mounting chamber 72.

The water-dispensing unit 12 comprises the mounting assembly 30 (see FIGS. 6 to 14). In an installed position, the mounting assembly 30 is arranged largely above the dispensing region 20 of the water-dispensing unit 12 (see FIGS. 6, 7 and 11). In the present exemplary embodiment, the mounting assembly 30 occupies an installation space with a volume of substantially 21.5 $cm^3$.

In the mounted state, the mounting assembly 30 is connected to the wall element 44. In the mounted state, the mounting assembly 30 is connected to the wall element 44 by means of a connection which is releasable without tools. In the present exemplary embodiment, the mounting assembly 30 is connected to the wall element 44 by means of a snap-in connection.

Figure 6:
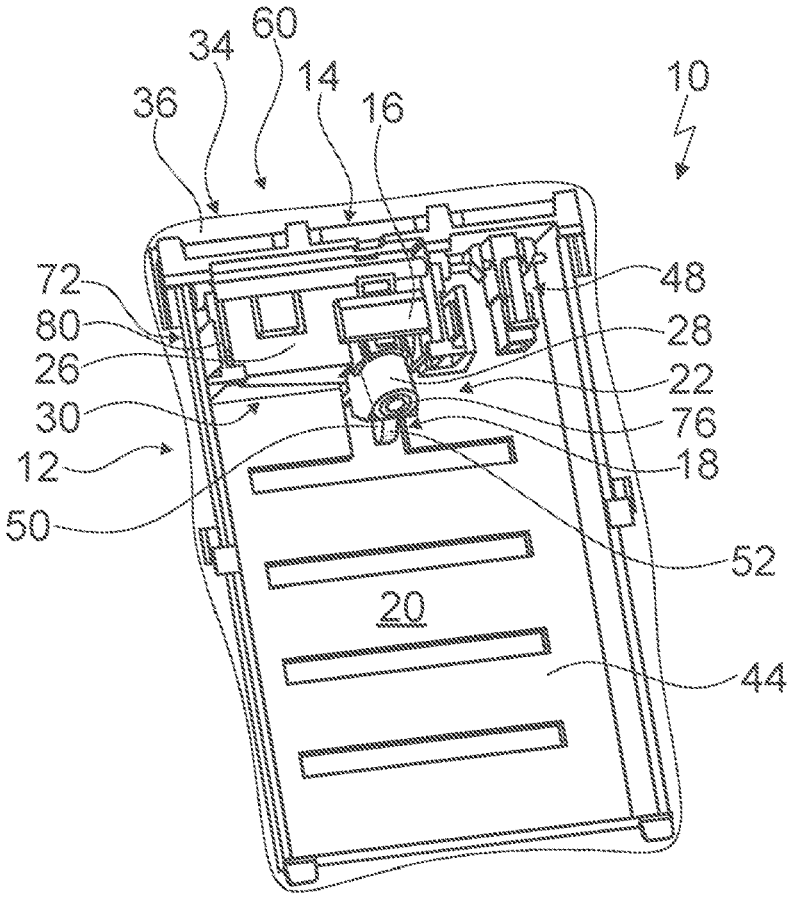
FIG. 6 shows the side wall, the wall element, the mounting assembly and an electrical connection of the refrigeration appliance apparatus in a schematic representation.
Figure 7:
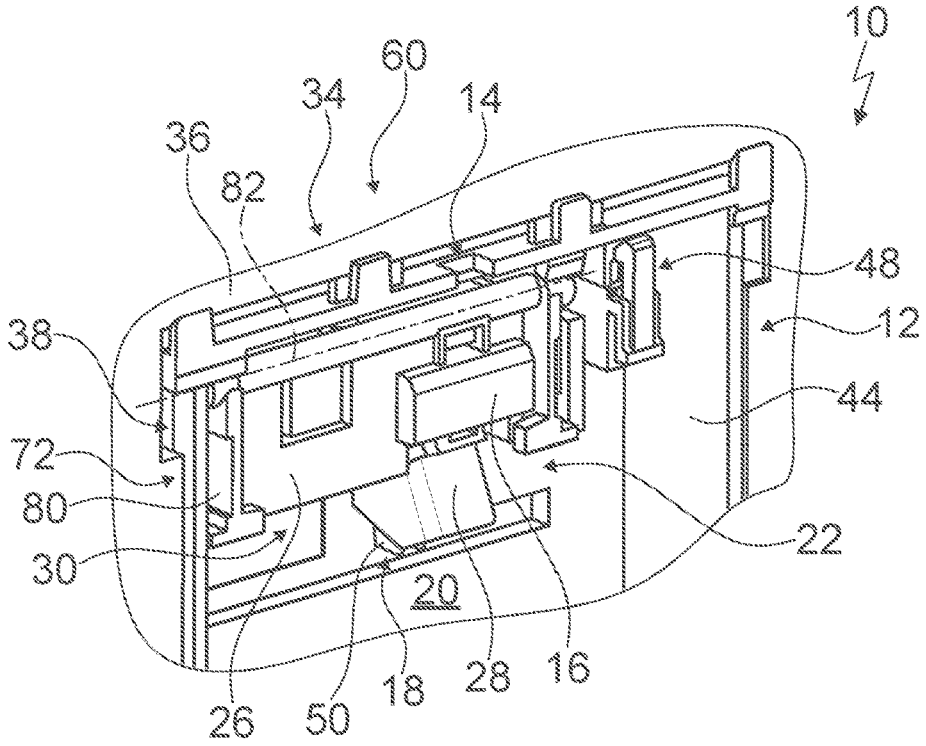
FIG. 7 shows the side wall, the wall element, a mounting assembly and the electrical connection in an enlarged schematic representation.
Figure 8:
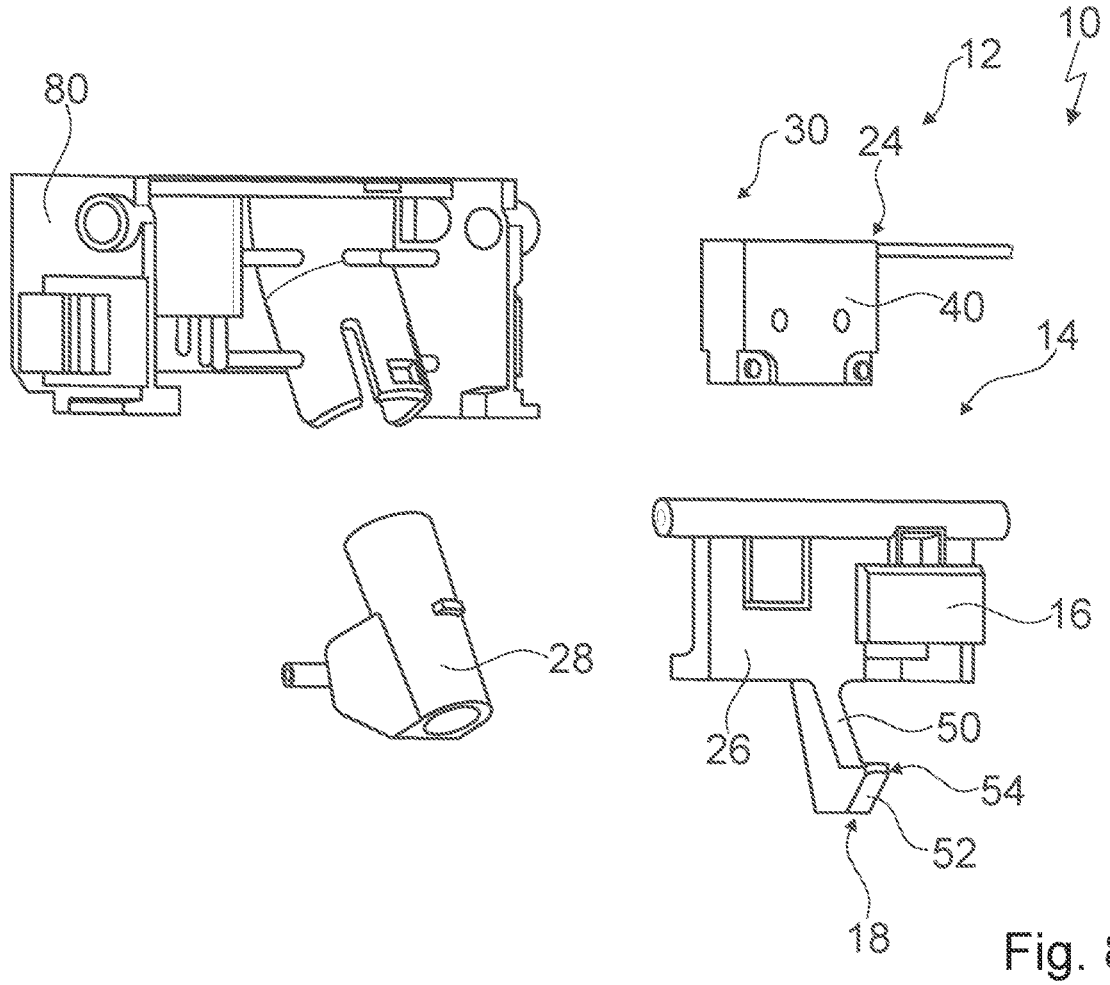
FIG. 8 shows the mounting assembly in a schematic exploded representation.
Figure 9:
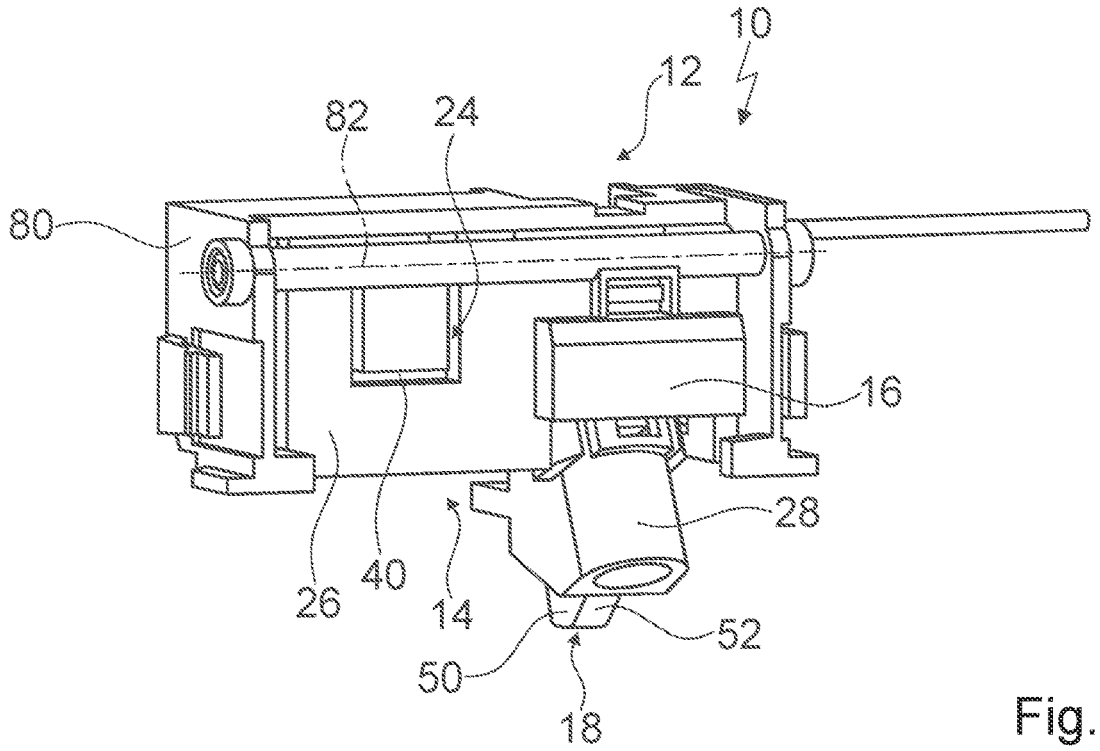
FIG. 9 shows the mounting assembly in an assembled state in a view from the front in a schematic representation.
Figure 10:
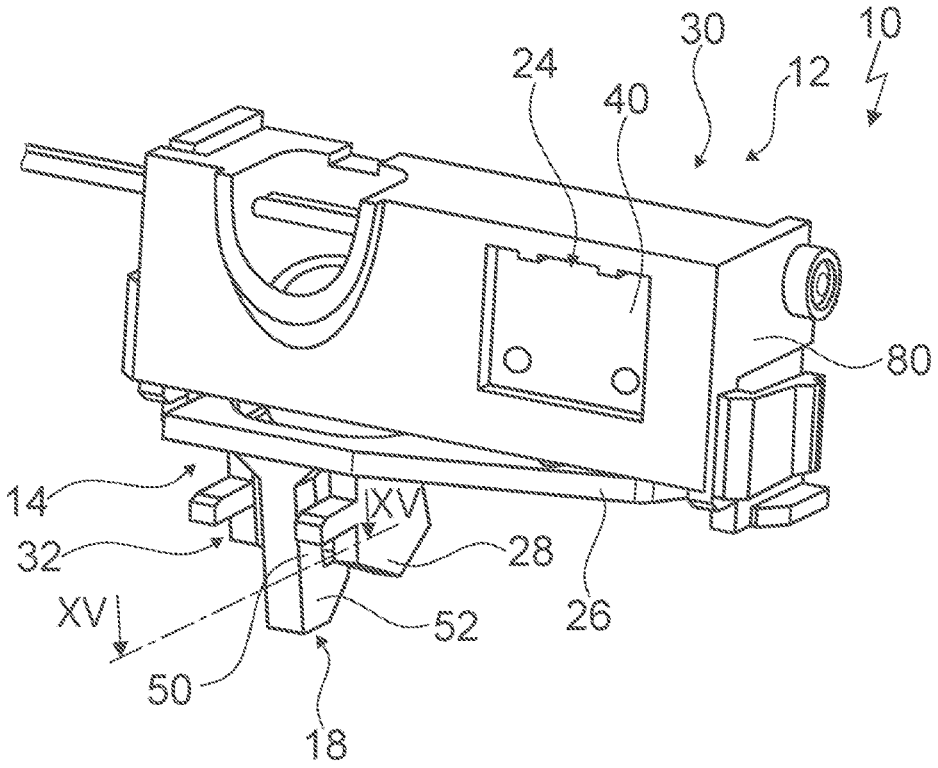
FIG. 10 shows the mounting assembly in an assembled state in a view from behind in a schematic representation.
Figure 11:
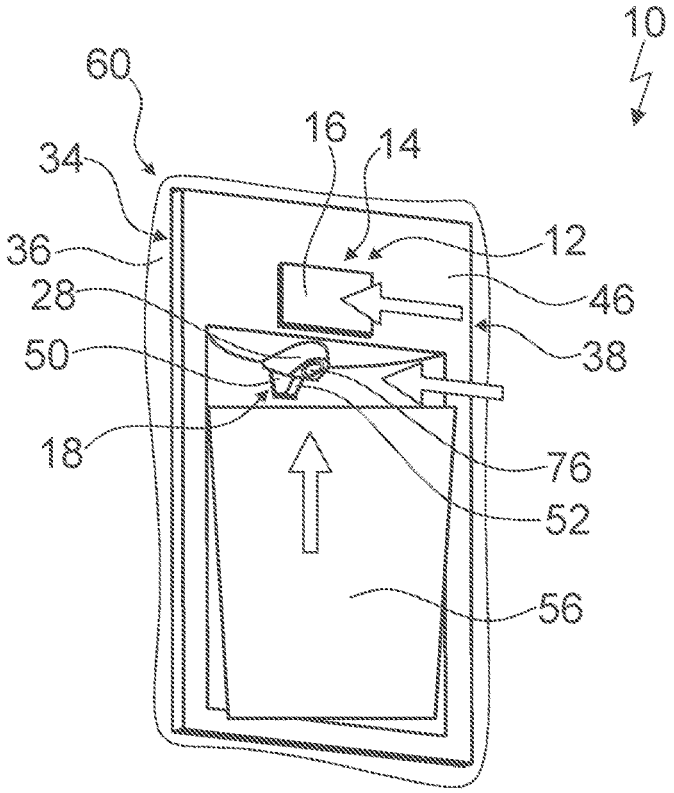
FIG. 11 shows the side wall, a faceplate unit of the water-dispensing unit and a vessel in a schematic representation.

In the mounted state, apart from the mounting assembly 30, an electrical connection 48 of the water-dispensing unit 12 is arranged in the mounting chamber 72 (see FIGS. 6 and 7). The water-dispensing unit 12 comprises the electrical connection 48. The electrical connection 48 is provided for a connection to an external energy source (not shown).

Figure 5:
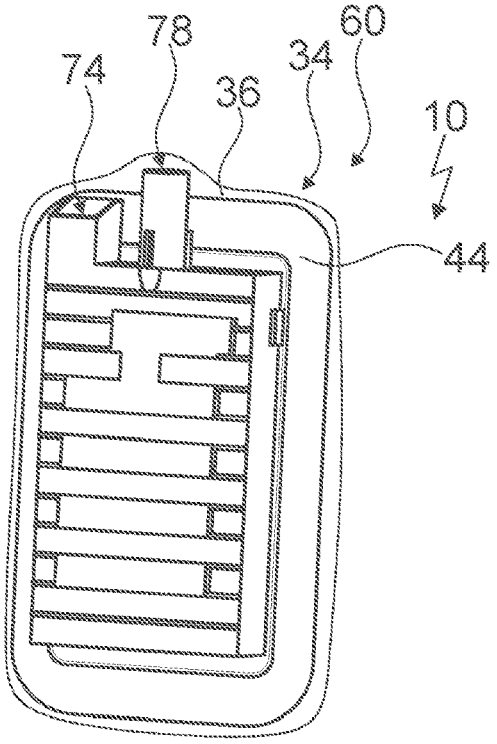
FIG. 5 shows the side wall and the wall element in a view from behind in a schematic representation.

The wall element 44 of the water-dispensing unit 12 comprises an energy input 74 (see FIG. 5). In the mounted state, the energy input 74 is arranged on a side of the side wall 36 facing away from the refrigeration chamber 62. In the mounted state, an energy cable (not shown) is fed from the external energy source through the energy input 74 to the electrical connection 48.

In an installed position, the electrical connection 48 is arranged above the dispensing region 20. In the mounted state, the mounting assembly 30 is arranged adjoining the electrical connection 48 (see FIGS. 2, 3, 6 and 7). In the mounted state, a switch element 24 which is part of the mounting assembly 30 is connected to the electrical connection 48. By means of the switch element 24, the mounting assembly 30 is connected to the external energy source.

The switch element 24 is part of an actuating unit 14 of the water-dispensing unit 12. The actuating unit 14 has the switch element 24 for starting a water removal (see FIGS. 8 and 12 to 14). The water-dispensing unit 12 comprises the actuating unit 14 (see FIGS. 6 to 14). The actuating unit 14 is part of the mounting assembly 30.

The actuating unit 14 comprises an actuating element 26 (see FIGS. 2, 3 and 6 to 14). The actuating element 26 is provided in order to actuate the switch element 24. In the present exemplary embodiment, the actuating element 26 is configured in one piece. The actuating element 26 is part of the mounting assembly 30.

The water-dispensing unit 12 comprises a guiding unit 28 (see FIGS. 2, 3 and 6 to 14). The guiding unit 28 is provided for the guiding of water. In the present exemplary embodiment, the guiding unit 28 is provided for an indirect guiding of water. In the mounted state, the guiding unit 28 guides a water-guiding element 76 (see FIGS. 6 and 11). The water-guiding element 76 is configured as a hose.

The wall element 44 of the water-dispensing unit 12 comprises a water input 78 (see FIG. 5). In the mounted state, the water input 78 is arranged on a side of the side wall 36 facing away from the refrigeration chamber 62. In the mounted state, the water-guiding element 76 extends through the water input 78 and through a large part of the guiding unit 28. In the present exemplary embodiment, the water-guiding element 76 ends at a side of the guiding unit 28 facing toward the dispensing region 20 almost flush with the guiding unit 28.

In an installed position, the guiding unit 28 is arranged partially in a cover region 22 of the dispensing region 20 of the water-dispensing unit 12. The guiding unit 28 projects out of the mounting chamber 72 into the dispensing region 20. The guiding unit 28 is part of the mounting assembly 30.

The water-dispensing unit 12 comprises a holding unit 80 (see FIGS. 6 to 10 and 12 to 14). The holding unit 80 is part of the mounting assembly 30. In the mounted state, the guiding unit 28 and the actuating unit 14 which comprises the actuating element 26 and the switch element 24 are mounted on the holding unit 80. In the present exemplary embodiment, the guiding unit 28 is mounted on the holding unit 80 by means of a snap-in connection.

The actuating element 26 is mounted on the holding unit 80 pivotable about a pivot axis 82 relative to the holding unit 80 (see FIGS. 7, 9 and 12 to 14). In an installed position, the pivot axis 82 is oriented substantially horizontally. In an installed position, the pivot axis 82 is oriented substantially parallel to a subsurface, in particular to a ground and/or a floor and/or a support surface.

In the mounted state, the holding unit 80 is connected to the wall element 44 and, in particular, is fastened to the wall element 44. In the mounted state, the holding unit 80 is arranged in the mounting chamber 72 as part of the mounting assembly 30. The mounting assembly 30 comprises the holding unit 80, the guiding unit 28 and the actuating unit 14 which comprises the actuating element 26 and the switch element 24.

In the mounted state, the mounting assembly 30 and the electrical connection 48 are arranged in the mounting chamber 72. The refrigeration appliance apparatus 10 comprises a faceplate unit 46 (see FIGS. 2, 3 and 11). The faceplate unit 46 has a form adapted to a form of a vessel 56. In the present exemplary embodiment, the faceplate unit 46 has a substantially concave curved form.

In the mounted state, the faceplate unit 46 largely covers the water-dispensing unit 12. With the exception of a first operating element 16, a second operating element 18 and the guiding unit 28, in the mounted state, the faceplate unit 46 completely covers the water-dispensing unit 12.

The actuating unit 14 has the first operating element 16 for starting a water removal (see FIGS. 2, 3, 6 to 9 and 11 to 14). The first operating element 16 is configured integrally with the actuating element 26. The actuating element 26 forms the first operating element 16.

In addition to the first operating element 16, the actuating unit 14 comprises the second operating element 18 for starting a water removal (see FIGS. 6 to 15). The second operating element 18 is configured integrally with the actuating element 26. The actuating element 26 forms the second operating element 18.

The first operating element 16 and the second operating element 18 are connected to one another by the actuating element 26. The actuating element 26 couples the first operating element 16 and the second operating element 18 to one another mechanically.

The first operating element 16 is provided for an actuation of the switch element 24 taking place indirectly and advantageously via the actuating element 26. The second operating element 18 is provided for an actuation of the switch element 24 indirectly and advantageously via the actuating element 26. The switch element 24 is actuatable by means of the first operating element 16 and the second operating element 18, in particular indirectly, advantageously via the actuating element 26.

Dependent upon an actuation of the first operating element 16 and/or of the second operating element 18, the actuating element 26 actuates the switch element 24. The actuating element 26 is provided for starting a water removal.

In the mounted state, the first operating element 16 is arranged substantially outside the dispensing region 20 of the water-dispensing unit 12. The first operating element 16 is arranged in a region of the water-dispensing unit 12 facing toward the refrigeration chamber 62.

In the mounted state, the second operating element 18 is arranged substantially within the dispensing region 20 of the water-dispensing unit 12. In an installed position, the second operating element 18 is arranged partially in the cover region 22 of the dispensing region 20 of the water-dispensing unit 12. The second operating element 18 projects into the dispensing region 20. In the mounted state, the second operating element 18 is arranged behind the guiding unit 28.

The second operating element 18 is formed partially by an actuating portion 50 of the actuating element 26. The actuating element 26 comprises the actuating portion 50. The actuating portion 50 projects into the dispensing region 20. In the mounted state, the actuating portion 50 protrudes forwardly behind the guiding unit 28.

The actuating element 26 comprises a hook 52. The hook 52 is arranged on the actuating portion 50. In the present exemplary embodiment, the hook 52 and the actuating portion 50 are integrally connected to one another. The hook 52 is oriented in the direction of the guiding unit 28.

In the dispensing region 20, the actuating element 26 is arranged in a vicinity of the guiding unit 28. In the mounted state, the actuating element 26 is arranged partially in an accommodating region 32 of the guiding unit 28. The guiding unit 28 comprises the accommodating region 32.

The actuating portion 50 and the hook 52 together form the second operating element 18. The second operating element 18 is provided for an actuation by means of a vessel 56. In the mounted state, the hook 52 has an engagement region 54 on a side facing toward the guiding unit 28 (see FIG. 15). The engagement region 54 is provided for an engagement of a vessel 56.

The hook 52 has a form adapted to a form of a vessel 56. In the present exemplary embodiment, the hook 52 has a substantially concave curved form in the engagement region 54.

Figure 14:
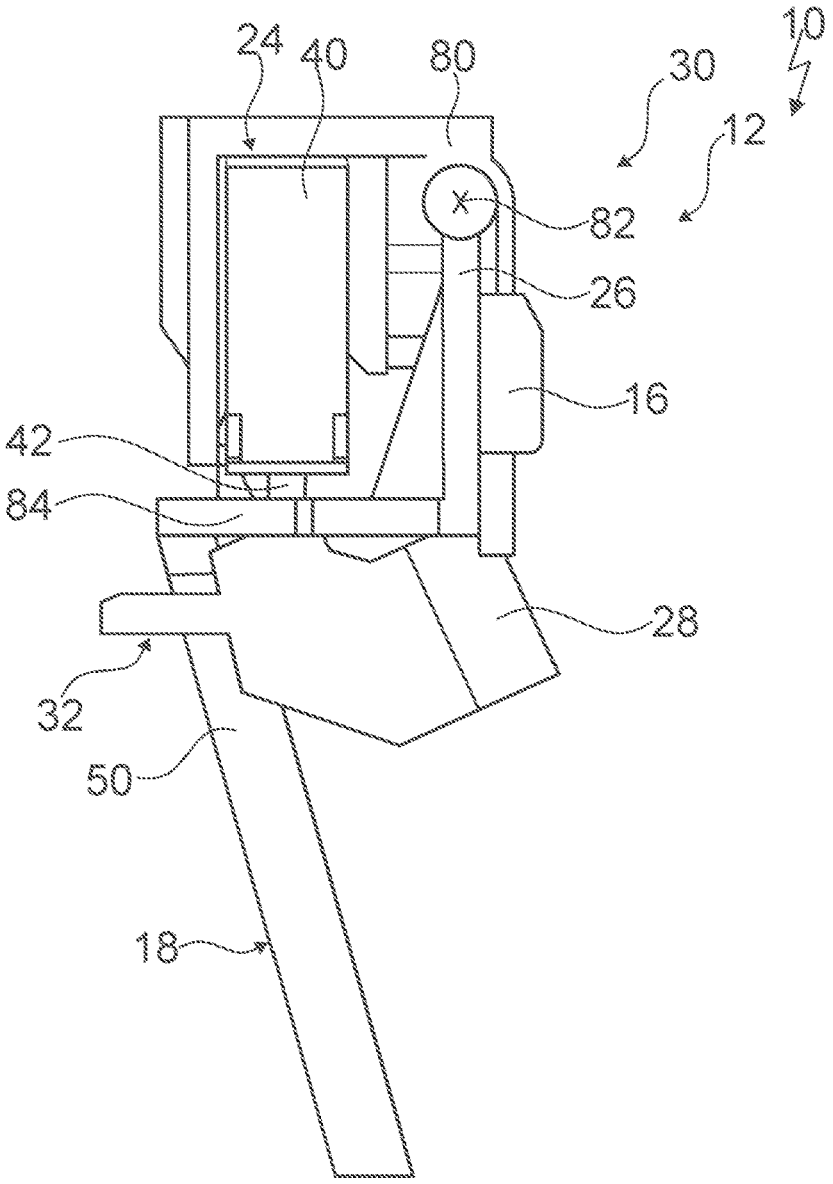
FIG. 14 shows an alternative mounting assembly in a non-actuated state in a schematic side view.
Figure 15:
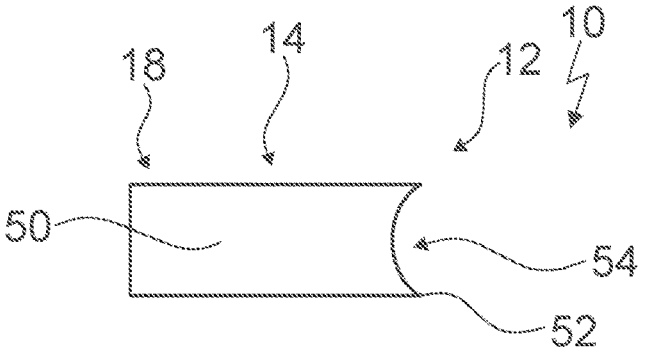
FIG. 15 shows a section along the line XV-XV of FIG. 10.

In an alternative embodiment, for example, a second operating element 18 is conceivable which could be free from a hook 52 (see FIG. 14). The second operating element 18 could be formed, for example, at least partially, in particular at least substantially and advantageously completely, by an actuating portion 50 of the actuating element 26. The actuating portion 50 could have, for example, an at least substantially web-shaped form.

In a method for operating the refrigeration appliance apparatus 10, an operator actuates the first operating element 16 and/or the second operating element 18. Dependent upon an actuation of the first operating element 16 and/or of the second operating element 18, the actuating element 26 actuates a triggering element 42 of the switch element 24 (see FIGS. 12 to 14). The switch element 24 comprises the triggering element 42.

The switch element 24 comprises a base body 40. In an installed position, the triggering element 42 is arranged on an underside of the base body 40. The switch element 24 is provided for a vertical actuation via the actuating element 26.

In at least one transverse plane, the actuating element 26 has a substantially stepped form. In an installed position, the actuating element 26 is arranged partially beneath the switch element 24. The actuating element 26 comprises a triggering portion 84 (see FIGS. 12 to 14). In an installed position, the triggering portion 84 is arranged beneath the switch element 24.

Figure 12:
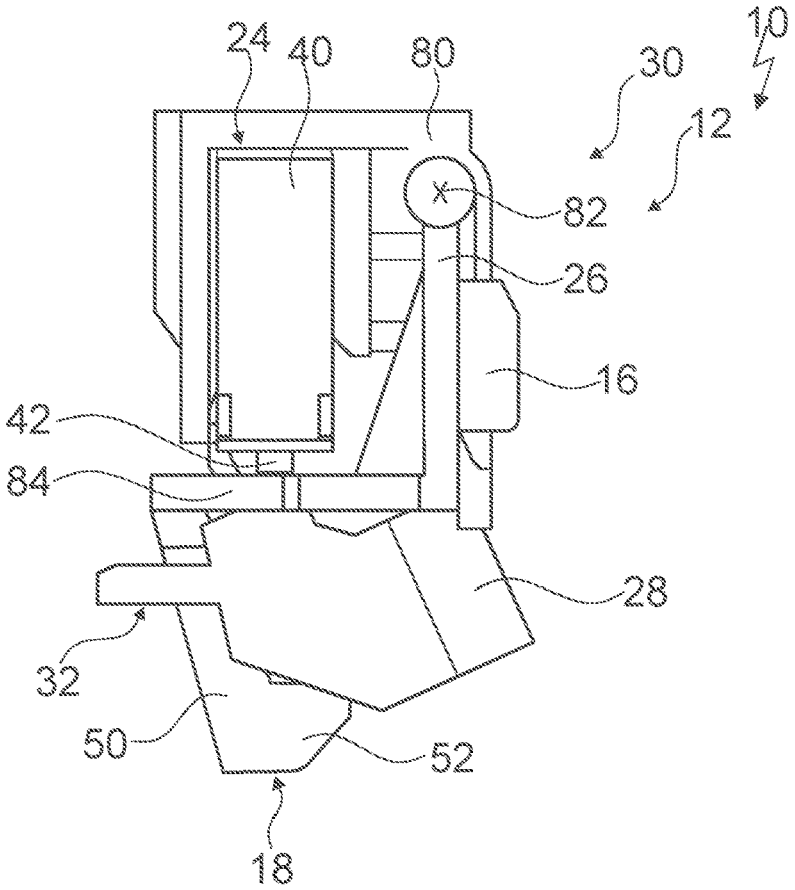
FIG. 12 shows the mounting assembly in a non-actuated state in a schematic side view.
Figure 13:
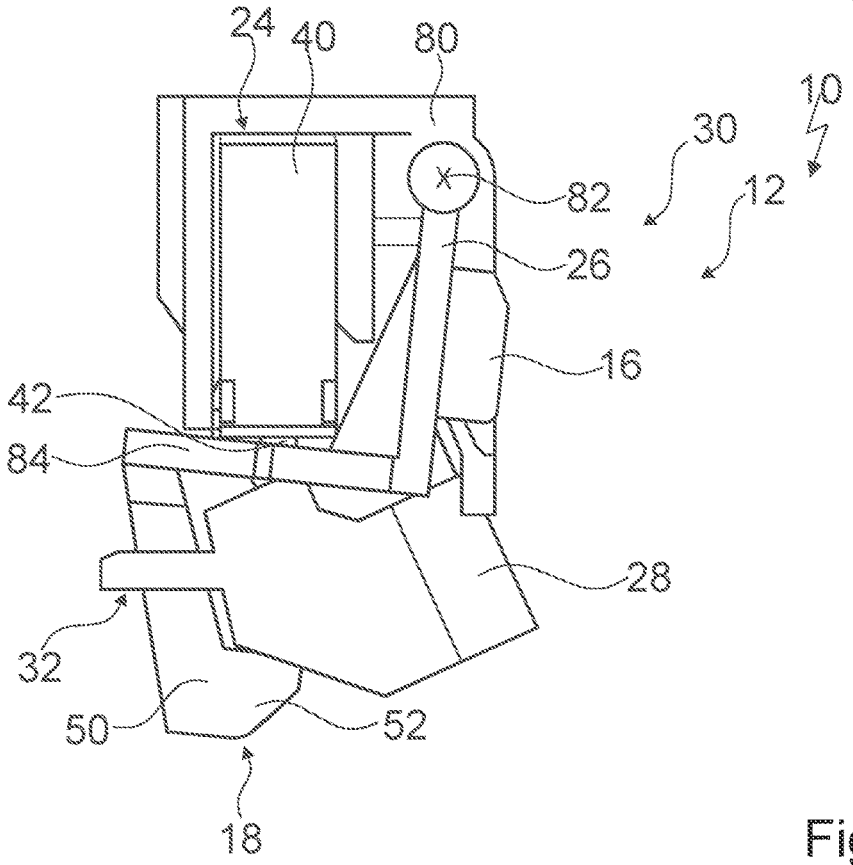
FIG. 13 shows the mounting assembly in an actuated state in a schematic side view.

For example, an operator actuates the first operating element 16 starting from a non-actuated state of the water-dispensing unit 12, for example, by means of a finger (see FIG. 12). By actuating the first operating element 16, in particular, vessels 56 with a large diameter can be filled.

The first operating element 16 is actuatable by means of a force acting substantially horizontally on the first operating element 16, which force could be evoked, in particular, by a substantially horizontally occurring movement, in particular, of the finger.

Dependent upon an actuation of the first operating element 16, the actuating element 26 pivots about the pivot axis 82. The triggering portion 84 of the actuating element 26 actuates the triggering element 42 of the switch element 24 (see FIG. 13). The switch element 24 starts the water removal.

The switch element 24 activates a valve unit of the refrigeration appliance apparatus 10 (not shown). Dependent upon the activation of the valve unit, water flows through the water-guiding element 76 into the vessel 56.

For example, an operator actuates, for example, by means of the vessel 56, the second operating element 18 starting from a non-actuated state of the water-dispensing unit 12 (see FIG. 12). By means of an actuation of the second operating element 18, in particular, vessels 56 with a diameter of up to substantially 120 mm can be filled. In particular, by actuating the second operating element 18 by means of the vessel 56, a one-handed operation can be enabled.

The second operating element 18 is actuatable by means of a force acting substantially horizontally on the second operating element 18, which force could be evoked, in particular, by a substantially horizontally occurring movement, in particular, of the vessel 56.

Alternatively or additionally, in particular, to a horizontally occurring actuation of the second operating element 18, the second operating element 18 is actuatable by a substantially vertically acting force on the second operating element 18, which force could be evoked, in particular, by a substantially vertically occurring movement, in particular, of the vessel 56. By means of the vertically occurring actuation, subsequently dripping water can be caught, in particular, by the vessel 56.

Dependent upon an actuation of the second operating element 18, the actuating element 26 pivots about the pivot axis 82. The triggering portion 84 of the actuating element 26 actuates the triggering element 42 of the switch element 24 (see FIG. 13). The switch element 24 starts the water removal.

The switch element 24 activates a valve unit of the refrigeration appliance apparatus 10 (not shown). Dependent upon the activation of the valve unit, water flows through the water-guiding element 76 into the vessel 56.

The following is a summary list of reference numerals and the corresponding structure used in the above description of the invention:

10 Refrigeration appliance apparatus
12 Water-dispensing unit
14 Actuating unit
16 First operating element
18 Second operating element
20 Dispensing region
22 Cover region
24 Switch element
26 Actuating element
28 Guiding unit
30 Mounting assembly
32 Accommodating region
34 Inner liner
36 Side wall
38 Recess
40 Base body
42 Triggering element
44 Wall element
46 Faceplate unit
48 Electrical connection
50 Actuating portion
52 Hook
54 Engagement region
56 Vessel
58 Refrigeration appliance
60 Appliance body
62 Refrigeration chamber
64 Appliance door
66 Further refrigeration chamber
68 Further appliance door
70 Outer liner
72 Mounting chamber
74 Energy input
76 Water-guiding element
78 Water input
80 Holding unit
82 Pivot axis
84 Triggering portion

The invention claimed is:

1. A refrigeration appliance apparatus, comprising:

an appliance body and an appliance door delimiting a refrigeration chamber;

a water-dispensing unit disposed on a side wall of said appliance body or appliance door, said water-dispensing unit having a guide for dispensing water;

said water-dispensing unit having at least one actuating unit, said actuating unit having a first operating element and at least one additional, second operating element for starting a water removal through said guide; and said first operating element being arranged at least substantially outside a dispensing region of said water-dispensing unit, and said first operating element being configured for direct contact with a vessel to be filled or with a user;

said second operating element being arranged substantially within a dispensing region of said water-dispensing unit, and said second operating element being configured for direct contact with a vessel to be filled or with a user.

2. The refrigeration appliance apparatus according to claim 1, wherein the apparatus is an apparatus of a domestic refrigeration appliance.

3. The refrigeration appliance apparatus according to claim 1, wherein said second operating element is arranged partially in a cover region of the dispensing region of said water-dispensing unit.

4. The refrigeration appliance apparatus according to claim 1, wherein said actuating unit having at least one switch that is actuatable by said first operating element and by said second operating element.

5. The refrigeration appliance apparatus according to claim 1, wherein said actuating unit comprises at least one actuating element disposed to mechanically couple said first operating element and said second operating element to one another.

6. The refrigeration appliance apparatus according to claim 5, wherein said actuating element is configured to actuate said switch element.

7. The refrigeration appliance apparatus according to claim 1, wherein said actuating unit and said guide form a part of a mounting assembly.

8. The refrigeration appliance apparatus according to claim 5, wherein said guide comprises at least one accommodating region in which said actuating element is at least partially arranged in a mounted state.

9. The refrigeration appliance apparatus according to claim 1, wherein said appliance body having an inner liner forming said side wall, and said water-dispensing unit is disposed on said side wall.

10. The refrigeration appliance apparatus according to claim 9, wherein said side wall is formed with a recess in which said water-dispensing unit is arranged in a mounted state.

11. A refrigeration appliance apparatus, comprising:

an appliance body and an appliance door delimiting a refrigeration chamber;

a water-dispensing unit disposed on a side wall of said appliance body or appliance door, said water-dispensing unit having a guide for dispensing water;

said water-dispensing unit having at least one dispensing region and said guide configured for guiding water, said guide, in an installed position, being disposed in a cover region of said at least one dispensing region of said water-dispensing unit; and said water-dispensing unit having at least one actuating unit with at least one actuating element provided for starting a water removal, said actuating element including at least one actuating portion which protrudes into said dispensing region and projects behind said guide; and said actuating unit having at least one first operating element and at least one second operating element, and each of said first and second operating elements being configured for direct contact with a vessel to be filled or with a user for starting the water removal.

12. The refrigeration appliance apparatus according to claim 11, wherein the apparatus is an apparatus of a domestic refrigeration appliance.

13. The refrigeration appliance apparatus according to claim 11, wherein said actuating element comprises at least one hook which is arranged on said actuating portion and is oriented in a direction of said guide.

14. The refrigeration appliance apparatus according to claim 13, wherein said hook comprises at least one engagement region configured for engagement with at least one vessel.

15. The refrigeration appliance apparatus according to claim 14, wherein said hook has a substantially concave-curved form in said engagement region.

16. The refrigeration appliance apparatus according to claim 11, wherein said actuating portion has a substantially web-shaped form.

17. The refrigeration appliance apparatus according to claim 11, wherein said first operating element is arranged at least substantially outside said at least one dispensing region of said water-dispensing unit.

18. The refrigeration appliance apparatus according to claim 17, wherein said second operating element is arranged at least substantially within said at least one dispensing region of said water-dispensing unit.

19. The refrigeration appliance apparatus according to claim 18, wherein said second operating element is formed at least partially by said actuating portion.

20. The refrigeration appliance apparatus according to claim 11, further comprising at least one faceplate unit which, in a mounted state thereof, covers said water-dispensing unit at least largely.

21. The refrigeration appliance apparatus according to claim 20, wherein said faceplate unit is curved in a substantially concave form.

22. The refrigeration appliance apparatus according to claim 11, wherein said appliance body having an inner liner forming said side wall, and said water-dispensing unit is disposed on said side wall.

23. The refrigeration appliance apparatus according to claim 11, wherein said side wall is formed with a recess in which said water-dispensing unit is arranged in a mounted state.

* * * * *